United States Patent [19]

Trivett

[11] Patent Number: 4,846,986

[45] Date of Patent: Jul. 11, 1989

[54] OIL-IN-WATER DRY FILM PRELUBE EMULSION

[75] Inventor: Robert L. Trivett, Aurora, Ill.

[73] Assignee: Nalco Chemical Company, Naperville, Ill.

[21] Appl. No.: 282,810

[22] Filed: Dec. 12, 1988

[51] Int. Cl.[4] ..... C10M 173/02

[52] U.S. Cl. ..... 252/49.5; 252/51.5 R; 252/52 R; 252/56 R

[58] Field of Search ..... 252/49.5, 56 R

[56] References Cited

U.S. PATENT DOCUMENTS

| | | | |
|---|---|---|---|
| 4,116,872 | 9/1978 | Jahnke | 252/565 |
| 4,191,658 | 3/1980 | Jahnke | 252/32.7 E |
| 4,256,594 | 3/1981 | Rysek | 252/49.9 |
| 4,346,148 | 8/1982 | Jahnke | 252/49.9 |
| 4,753,743 | 6/1988 | Sech | 252/51.5 A |

*Primary Examiner*—William R. Dixon, Jr.
*Assistant Examiner*—Ellen McAvoy
*Attorney, Agent, or Firm*—John G. Premo; Anthony L. Cupoli; Donald G. Epple

[57] ABSTRACT

An oil-in-water emulsion useful as a metal working lubricant. The emulsion includes water, a oil-in-water emulsifier, a film plasticizer, and a boundry lubricant. A corrosion inhibitor may also be included.

20 Claims, No Drawings

OIL-IN-WATER DRY FILM PRELUBE EMULSION

TECHNICAL FIELD OF THE INVENTION

The present invention is in the technical field of metalworking operations and lubricants used therein, particularly prelubes for steel in automotive and appliance applications.

BACKGROUND OF THE INVENTION

Lubricants are generally employed in metalworking operations. Such operations include rolling, forging, blanking, bending, stamping, drawing, cutting, punching, spinning, extruding, coining, hobbing, swaging, and the like. The present invention concerns lubricants for such type of metalworking operations, and in particular such operations as employed in automotive and appliance applications. In the automotive and appliance fields, the term "stamping" is used as a broad term to cover all pressworking operations on sheet metal, which operations may be further categorized as cutting, drawing, or coining. Automotive and appliance stamped parts may be produced by one or a combination of these three fundamental operations.

Metalworking lubricants facilitate these operations generally by reducing friction between the metal being worked and the tooling employed for that process, and thus reducing the power required for a given operation, reducing the wear of the surfaces of the tooling that operate on the metals, and preventing sticking between the metal being worked and the tooling operating thereon or between metal pieces during storage, handling or operations, and in addition often provide corrosion protection to the metal being processed. In automotive and appliance applications prevention of sticking between metal pieces and between such pieces and the work elements is of extreme importance.

In some metalworking processes, including automotive and appliance applications, coils or rolls of steel, in particular cold rolled or galvanized steel sheets, are cut into pieces, called blanks, which are stamped or drawn to produce the desired parts. Such automotive parts formed by stamping or drawing, as these terms are generally used, include fenders, hoods, deck lids, quarter panels, oil pans, fuel tanks, floor panels, inner and outer door panels, and the like. Appliance parts, formed by stamping and drawing, as these terms are generally used, include washer tops, dryer tops, washer fronts, dryer fronts, top and front lids and dryer tumblers, and the like. Prior to the use of lubricants known as prelubes the normal procedure was to apply an oil at the steel mill to such coils or rolls as a rust preventative prior to shipping to the processing site, such as a stamping plant. Between the steps of cutting the sheets into blanks and stamping or drawing, such rust preventive oil would then be removed by cleaning and a drawing lubricant applied to the metal and at times the work element immediately before stamping or drawing. Such drawing lubricant is used to reduce friction and facilitate the metalworking operation.

In recent times the use of separate rust preventive oils and drawing lubricants has been in some instances replaced by the use of a single composition known as a prelube. Prelubes are generally applied at the steel mill during temper rolling or inspection, as would be a rust preventive oil, prior to shipping and are not intentionally removed from the metal until after the blanks are cut and the parts formed. Thus the use of such prelubes eliminates the steps of removing the oil and applying a drawing lubricant before further working.

Prelubes thus must function as both a rust preventative and drawing lubricant. In many instances, and particularly for automotive and appliance applications, a prelube must be removable with alkaline cleaners, nonstaining to the metal, and compatible with other chemicals utilized in producing the products in question.

In more detail, the advantages obtained by the efficiency of using a prelube would be diminished or nullified if unusual methods were necessary to remove the lubricant from the final product. In the automotive and appliance fields, alkaline cleaners are the normal compositions employed for cleaning. Some substances with lubricating properties, for instance hydrocarbon wax films, cannot be easily removed with alkaline cleaners and thus their use entails a serious detrimental effect on the efficiency of overall operations.

As to metal staining, there are at times instances where steel coils are stored for long periods before use. Some substances may oxidize to an extent during storage and the oxidation product adversely effect the metal, for instance by the oxidation of oils to fatty acids which stain steel sheets, particularly mild steel sheets. Hence industries in which storage periods are a potential require prelubes or other substances in contact with the metal during storage that are substantially nonstaining.

As to compatibility with other chemicals, parts are sometimes formed with severe bends which may entrap some of the lubricant used in the metalworking operation. Thus although the lubricant may be removed after working from all exposed surfaces, the entrapped portion remains and may be vaporized or otherwise released under subsequent processing conditions. The potential for releasing of entrapped lubricant thus requires compatibility between the lubricant and cathodic primers, automotive adhesives, and appliance porcelain. The cathodic primers are used in electrostatic coating operations. Adhesives are used to bond automotive parts where welding or other methods are unsuitable. Porcelain enamel coatings are applied to some appliance parts to improve quality and life of the part. Although some parts being formed in a typical stamping plant will not be painted nor come into contact with adhesives, and thus the use of noncompatible lubricants thereon would pose minimal risks, efficiency in the overall operations makes it highly desirable to utilize the same lubricant or prelube throughout the plant.

The prelubes now used commercially in the automotive and appliance industries are hydrocarbon based compositions containing sulfurized or waxy components, liquid at ambient room temperature. These compositions tend to drain off the metal surfaces, creating maintenance problems, and further tend to be or become unevenly distributed on the metal surfaces due to capillary forces. The properties of rust prevention and drawing assistance both depend in significant part on uniformity of lubricant film. Such tendency to puddle on the metal surface diminishes a lubricant's potential in providing protection from rust and in facilitating the stamping or drawing operations. Thus at least the automotive and appliance industries desire a prelube that provides lubricant film uniformity and film strength undiminished during shipping and storage periods. Further, film strength is a particularly significant property for facilitating drawing operations; a lubricant having high film strength will permit more severe draws to be made. Further, with these hydrocarbon based compositions, housekeeping and cleanliness are extremely hard to maintain. These compositions leak onto tooling surfaces, contaminate floor trenches and waste treatment streams, volatilize into the air and create dermatitis on the press forming personnel. Thus at least the automotive and appliance industries desire a prelube that reduces or eliminates these problems.

A lubricant that is effective for each of the purposes for which it is employed at use levels less than those otherwise encountered is desirable, contributing to the cost efficiency of any given operation.

It is an object of the present invention to provide a metalworking lubricant, and more particularly a lubricant that may be used as a prelube, that provides the foregoing desirable characteristics and permits the attainment of the foregoing advantages in the metalworking field, and in particular in the automotive and appliance industries. It is a further object of the present invention to provide a method of lubricating metal, particularly cold rolled and galvanized steel sheets, particularly prior to stamping and drawing operations, that provides the foregoing desired advantages. These and other objects of the invention are described below.

DISCLOSURE OF THE INVENTION

The present invention provides a lubricant in an oil-in-water emulsion. Lubricant can be readily applied to a metal substrate without prior heating of either the lubricant or the substrate. Under normal application conditions, the water readily evaporates leaving a dry film lubricant on the coated metal.

The lubricant includes from 55 to 80 weight percent deionized water, from 2–10% emulsifier, together with traditional lubricant ingredients such as a plasticizer, corrosion inhibitor, wetting agent, boundary lubricant, and the like.

Preferably, the lubricant emulsion will contain from 70–80% water, from 2–8% emulsifier, and a film plasticizer, a boundary lubricant and a corrosion inhibitor.

Examples of satisfactory ingredients for a dry lube composition are provided in U.S. Pat. No. 4,753,743 which is incorporated herein by reference.

The Emulsifier

An emulsifier having an HLB of from 8 to 19 are preferred for enabling the emulsions of this invention. Preferably, the emulsifier will have an HLB of from 8 to 11. A most preferred emulsifier is the ester reaction product formed from stearic acid and 2-amino-2-methyl-1-propanol. It is noteworthy that 2-amino-2-methyl-1-propanol also acts as a corrosion inhibitor in the dried film and provides reserve alkalinity in the oil-in-water emulsion.

The Lubricant

The preferred lubricant includes at least one substantially saturated ester formed of a polyhydric alcohol and at least one carboxylic acid, from 0.1 to 5 weight percent of a partially-esterified vegetable oil, an air-oxidized vegetable oil, an aspartic acid diester, oleic acid, imidazoline, or mixtures thereof, and from 0.1 to 3.0 weight percent of an ethylene homopolymer, a polymer derived from ethylene and ethylenically unsaturated carboxylic acid monomers, oxidized derivatives of ethylene polymers, or mixtures thereof.

In preferred embodiments the substantially saturated ester is formed of an aliphatic polyhydric alcohol having from 2 to 10 carbon atoms and aliphatic monocarboxylic acids having from 2 to 26 carbon atoms. The aliphatic monocarboxylic acids preferably have substantially unbranched carbon chains. The ester preferably has a melting point of from 30° to 100° C.

In more preferred embodiments the substantially saturated ester is a diglyceride or triglyceride formed with carboxylic acids at least 90 percent of which have carbon chains containing from 14 to 22 carbon atoms. A very preferred embodiment is a triglyceride, the substantially refined hydrogenated triglyceride derived from tallow is a composition having an acid number from 0 to 9, a composition having a saponification number of 150–250 particularly having an acid number of from 0 to 5 and a saponification number of 190–210.

In further preferred embodiments the partially-esterified vegetable oil and/or air-oxidized vegetable oil are derived from castor oil, soybean oil, rape seed oil, cotton seed oil, or mixtures thereof. In preferred embodiments, the aspartic acid diester and oleic acid imidazoline is primarily a mixture of a diester of L-aspartic acid and an imidazoline based on the reaction between oleic acid and AEEA (aminoethylethanolamine), aspartic acid diester oleyl imidazoline is composition having an acid value of 50–100 and an alkali value of 5–50 and is a fluid composition at ambient temperature, particularly having an acid value of 65–75 and an alkali value of 30–40.

In preferred embodiments the ethylene homopolymer, polymer derived from ethylene and ethylenically unsaturated carboxylic acid monomers, oxidized derivatives thereof, or mixtures thereof, is a composition having a melting point of from 85° to 115° C., a composition having a hardness of from 9 to 22 dmm at 25° C., a composition having an acid number of from 70 to 140, particularly a copolymer of ethylene and acrylic acid having a hardness of from 12 to 16 and an acid number of from 110 to 130.

The lubricant preferably has from 10 to 20 weight percent of at least one substantially saturated ester formed of an aliphatic polyhydric alcohol having from 20 to 10 carbon atoms and aliphatic monocarboxylic acids having from 2 to 26 carbon atoms. The most preferred lubricant composition of this invention contains at least 2 weight % oil-in-water emulsifier having an HLB of at least 8;

from 60 to 80 weight % deionized water;

at least one substantially saturated ester formed of polyhydric alcohol and at least one carboxylic acid;

an effective plasticizing amount, comprising from 0.1–5 weight percent, of a partially-esterified vegetable oil formed from an organic diacid having a molecular weight of from 250 to 500, and an air-oxidized vegetable oil, L-aspartic acid diester/oleyl imidazoline blend; and from 0.1 to 3.0 weight percent of an ethylene homopolymer, a polymer derived from ethylene and ethylenically unsaturated carboxylic acid monomers, oxidized derivatives of ethylene polymer, or mixtures thereof, said polymers having a molecular weight in excess of 2,000.

These and other preferred embodiments are described in more detail below.

Oxidants

The lubricant may further include from 0.1 to 3.0 weight percent of an antioxidant, particularly a hindered phenol type antioxidant.

Method of Application

The lubricant may be applied by dipping, rollcoating, brushing or electrostatic spraying. After the lubricant has been applied, evaporation of the water will occur leaving a dry prelube lubricant on the surface of the substrate which has been coated.

Preferred Embodiments of the Invention

The lubricant according to the present invention is an oil-in-water emulsion type of coating particularly useful in metalworking operations and particularly advantageous in metalworking operations as a prelube for automotive and appliance metalworking applications. The coating is characterized as a prelube dry film because only a dry film is left when the water evaporates. The automotive and appliance industries employ many stamped parts, i.e., parts produced by one or a combination of various pressworking operations, which may be subcategorized as cutting, drawing, and coiling operations. Lubricants are employed during these and other metalworking operations to reduce the power required, the surface wear on the work elements (tooling), and the possibility of the metal pieces adhering to the work elements (tooling) or each other. In addition it is desirable that such lubricant also provide corrosion protection to the metal on which it is coated. In some metalworking applications, for instance automotive and appliance stamping operations, it is highly desirable to use a lubricant that can be applied to the coils or rolls of steel sheets before shipping to the stamping plant, for instance during the temper rolling or inspection, whereby corrosion protection during shipping, handling, or storage is accomplished, and which also performs as a metalworking lubricant during subsequent operations, whereby the steps of removing one coating and applying another are eliminated. As mentioned above, such lubricants are called prelubes and must function as both rust preventatives and drawing lubricants. The lubricant according to the present invention, as described in more detail below, is generally one that is liquid at ambient room temperature and is applied to the metal in oil-in-water emulsion form. Evaporation of the water from this oil-in-water form results in a uniform dry lubricant film on the metal surface.

As mentioned above, the properties of rust prevention and drawing assistance are both dependent in significant part on the uniformity of lubricant film and these goals are greatly advanced by a lubricant with which one can achieve a uniform coating in the first instance which uniformity is substantially retained until it is desired to remove the coating, such as the lubricant of the present invention.

The lubricant according to the present invention contains at least one substantially saturated ester formed of a polyhydric alcohol and at least one carboxylic acid. Such esters generally comprise a major portion of the lubricant and are believed to provide both lubricity and film-forming properties to the lubricant, and in preferred embodiment have melting points of from 30° C. to 100° C. (86° F. and 212° F.). Generally the selection of such esters and other lubricant components will provide an oil-in-water emulsion lubricant that is substantially liquid at ambient room temperature and yet is easily coated onto metal at ambient or elevated temperatures to provide a uniform coating upon evaporation of the water.

The polyhydric alcohol portion of such esters preferably are aliphatic alcohols such as ethylene glycol, glycerol, pentaerythritol, and the like, preferably being polyhydric alcohols having from 2 to 10 carbon atoms. The carboxylic acids forming the esters preferably are aliphatic monocarboxylic acids, and more preferably are such acids comprised of from 2 to 26 carbon atoms. The esters may be formed of carboxylic acid moieties of various carbon atom chain lengths and mixtures of branched and unbranched carbon chains, but preferably the unbranched carbon chain moieties will predominate.

In preferred embodiment the esters are substantially saturated diglycerides and triglycerides formed with carboxylic acids at least 90 percent of which have carbon chains containing from 14 to 22 carbon atoms. A particularly useful ester is one formed substantially of the trihydric glycerol and carboxylic acids at least 90 percent of which have carbon chains of 16 to 18 carbon atoms, such as the substantially refined hydrogenated triglyceride derived from tallow, having a melting point of about 52° C. (126° F.) and wherein about 30 percent of the carboxylate chains are those having 16 carbon atoms and about 65 percent of the carboxylate chains are those having 18 carbon atoms, the remainder being chains of 14 carbon atoms (2%), 15 carbon atoms (0.5%), and 17 carbon atoms (2.5%).

It has been found that such substantially saturated esters do not alone provide sufficient film flexibility to the lubricant coating for metalworking applications and handling attendant thereupon. The lubricant according to the present invention further contains from 0.1 to 5.0 percent of certain compositions, all somewhat polar, of high viscosity at the elevated temperatures required to render the lubricant molten, and compatible with the substantially saturated esters. As mentioned above, these compositions are partially-esterified vegetable oils, air-oxidized vegetable oils.

The lubricant, as an oil-in-water emulsion, upon evaporation of the water, leaves a dry film prelube upon the metal substrate. Because the lubricant is water-based, additional corrosion inhibitors are necessary to provide improved corrosion protection for the dry film to the metal substrate.

The lubricant according to the present invention also contains from 0.1 to 5.0 percent by weight of a composition comprised of a blend of L-aspartic acid diester and oleic acid imidazoline, more specifically L-aspartic acid, N-(3-carboxy-1-oxo-2-propenyl)-(-N-octadecyl-, bis (2-methyl propyl) ester, Z and 1-H-imidazole-1-ethanol, 2-(heptadecenyl)-4,5-dihydro. Such composition having an acid value of 50–100 and an alkali value of 5–50 and is a fluid composition at ambient temperature, particularly having an acid value of 65–75 and an alkali value of 30–40. Such composition provides not only the necessary corrosion protection required for the dried film on the metal substrate but also acts in conjunction with the stearic acid -2-amino-2-methyl-1-propanol ester as a secondary emulsifier to form the oil-in-water emulsion lubricant described according to the present invention.

The lubricant according to the present invention also contains from 0.1 to 3.0 weight percent of a polymeric composition comprised of an ethylene homopolymer, a polymer derived from the polymerization of ethylene and ethylenically unsaturated carboxylic monomers, oxidized derivatives of such ethylene polymers, and mixtures thereof. Such polymeric compositions preferably have molecular weights in excess of 2,000 and melting points of form 85° to 115° C. (185° to 239° F.). These polymers have been found to provide to the lubricant film strength and lubricity and thus, together with the substantially saturated esters and the certain plasticizing compositions described above, result in a lubricant that has superior film strength and lubricity for metalworking applications upon evaporation of the water. In preferred embodiments such polymer has a hardness of from 9 to 22 dmm (at 25° C.) and an acid number of from 70 to 140(mg KOH/g). A particularly preferred polymer is an ethylene based polymer comprised of units derived from ethylene and acrylic acid, with a melting point of from 90° to 110° . A particularly useful ethylene/acrylic acid copolymer is one having a hardness of from about 12 to 16 and an acid number of from about 110 to 130.

The lubricant according to the present invention provides a uniform film that is retained during handling and working to a degree not achievable with an oil-based lubricant. This is because, once the water evaporates from the emulsion, only a dry film lubricant remains on the coated metal substrate. Due to the uniformity and strength of the film coating provided by the lubricant, more severe draws can be made in metal working. Most draws can be made using a coating thickness (weight of lubricant per unit area basis) that is one-fifth of that required for conventional metalworking lubricants, thus a great materials savings is achieved with the lubricant of the present invention. Further, as demonstrated below, the lubricant is easily removable with a standard alkaline cleaner and thus is compatible with conventional processing methods used in the automotive and appliance industries. It has been found compatible with conventional processing methods used in the automotive and appliance industries. It has been found compatible with electrocoated paint primers and with adhesives commercially used in the automotive industry. In addition, the lubricant of the present invention has been found to provide rust protection to metals that far exceeds any hydrocarbon rust preventative.

The lubricant according to the present invention may include from 0.1 to 3.0 weight percent of an antioxidant, such as a hindered phenol antioxidant which has been found compatible with the components of the lubricant. Such an antioxidant additive may be considered when the potential for lubricant staining of mild metal is of serious concern, as an additional protection measure. The lubricant of the present invention might further include other additives but in preferred embodiment is limited to the components described above.

In a preferred embodiment, the lubricant is comprised of 10 to 20 weight percent of at least one substantially saturated ester formed from an aliphatic polyhydric alcohol having from 2 to 10 carbon atoms and an aliphatic monocarboxylic acid having from 2 to 26 carbon atoms, from 0.1 to 5 weight percent of the plasticizing compositions described above. In a further preferred embodiment such lubricant may further contain 0.1 to 3.0 weight percent of an antioxidant.

The lubricant of the present invention is particularly useful as a prelube, particularly a prelube for automotive and appliance applications. It was properties, however, may make it an excellent selection as a lubricant outside of such application, and within such applications may also be applied to work elements, such as dies and the like.

The lubricant according to the present invention may advantageously be coated onto metal by passing the metal through a liquid bath, at ambient temperatures removing the excess by squeegy or rollcoating methods and then evaporating the water from the coating. The lubricant may be brushed on or applied in any manner suitable for a viscous liquid, including electrostatic spray.

The advantages and utility of the lubricant according to the present invention are further described in the following examples.

EXAMPLE 1

A lubricant, according to the present invention, was prepared as follows:

Two blending vessels equipped with mechanical means of heating and stirring were used. Both vessels were well insulated to allow for uniform heating and cooling.

The following ingredients were added and mixed in the first vessel: 16.6 parts by weight of a refined hydrogenated triglyceride derived from tallow, commercially available under Witco Chemical Company trademark NEUSTRENE 060; 1.0 parts by weight of an ester derivative of castor oil and 0.2 parts by weight of a hindered phenol antioxidant, commercially available under the Shell Oil Company trademark IONOL; 0.2 parts by weight of an ethylene-acrylic acid copolymer, commercially available under the Allied Corporation trademark of AC-5120, and 2.0 parts by weight of an aspartic acid diester-oleic imidazoline blend, commercially available under the Mona Industries, Inc. trademark, MONACOR 39. The mixed blend was heated to 160° F. An amber liquid was produced.

While holding the mixture temperature at 160° F., 5.0 parts by weight of double pressed stearic acid, commercially available under the registered trademark of CENTURY 1220, belonging to Union Camp Co., is added. A homogeneous uniform liquid was produced.

In the second vessel, 74.0 parts by weight of deionized water was stirred at constant speed and heated to 160° F. The water temperature was then maintained with constant stirring at 160° F. 1.0 part by weight of 2-amino-2-methyl-1-propanol, commercially available under the registered trademark of AMP-95 from Angus Chemical Company, was then added to water and stirred at 160° F. until a clear, homogeneous solution was obtained.

With both vessel mixtures stabilized at 160° F., the water-2-amino-2-methyl-1-propanol solution from the second vessel was added in several portions into the vortex of the homogeneous mixture in the first vessel. A white opaque emulsion was formed.

Stirring in the first vessel was increased to ensure formation of a homogeneous emulsion as the two mixtures were brought together and the emulsion viscosity increased. After all the water mixture was added, heating was discontinued and the emulsion was cooled with constant stirring to 100° F. The final product was a white, slightly viscous, opaque emulsion having a uniform, homogeneous consistency.

The product can be characterized as follows:

| | |
|---|---|
| Appearence: | White opaque emulsion |

-continued

| | |
|---|---|
| Odor: | Neutral |
| pH (as is): | 8.3–8.8 |
| Brookfield Viscosity: | 180–250 cps |
| Weight/Gallon (25° C.): | 7.90 |
| Specific Gravity (25° C.): | 0.948 |

Dries to a white, opaque film.

Further Description of Example 1 Ingredient

The chemicals used to prepare the pre-lube composition of Example 1 are further characterized below:

The refined hydrogenated tallow triglyceride product had an iodine value of 1.0, an acid number of about 2.5, a saponification number of from a minimum of 193 to a 205 maximum and a melting point of 140°–145° F. and a carbon chain composition as follows:

2.0% $C_{14}$ 0.5% $C_{15}$; 30.0% $C_{16}$; 2.5% $C_{17}$ and 65.0% $C_{18}$.

The castor oil ester derivative with an acid number of approximately 50 was derived from a commercial organic diacid with a molecular weight of 350. The ethylene acrylic acid copolymer was one having an acid number (mgKOH/g) of about 120 with hardness (ddm at 25° C.) of 11.5 maximum and a melting point of 92° C. (198° F.). The aspartic acid diester-oleic imidazoline blend had an acid number of about 70 and an alkali number of about 36. The double pressed stearic acid has a molecular weight of about 285, an acid value of approximately 210 with an accompanying saponification value of about 211 and an iodine value of 6.0. The amino-methyl-propanol has a neutralization value ranging from a minimum of 93 to a maximum of 97.

EXAMPLE 2

The lubricant prepared in Example 1 was coated onto various types of steel panels in the laboratory as follows:

A steel panel was cleaned with xylene and hexane. When dry, the panel weight was recorded to 1/10,000 the of a gram on a precise analytical balance (such as a Mettler). The lubricant was applied to steel test panel at ambient conditions by one of three methods:

brushing the lubricant onto the panel, dipping the panel into the lubricant, or applying a uniform film of lubricant via a metal drawbar coating rod.

The coated panels were dried for sixty minutes at ambient temperatures to evaporate all water from the lubricant allowing the film to set. The dried panels were then reweighed again on the same scale and lubricant coating weights are then calculated and reported in milligrams per square foot.

These coating methods are adequate only for small laboratory applications and preparations. For commercial applications, the lubricant may be applied by an electrostatic spray, by dipping the metal through a bath of lubricant or by a series of coating rolls using the pressure of the rolls and the gap between the metal and coating roll as well as the speed of the moving steel strip to determine coating weight.

Despite the coating method, the lubricant according to the present invention dries to a smooth, opaque film on all types of steel with excellent surface adhesion and wetting properties providing a homogeneous and consistent film coating on the metal substrate.

EXAMPLE 3

The lubricant as designed in Example 1 above was tested to determine its drawing characteristics using the Double Draw Bead Simulator. 2×12" test strips of commercially produced steels were used of the following: 0.025" cold rolled steel, 0.029" two-sided hot dip galvanized and 0.031" two-sided electrolytic galvanized.

Lubricant was applied to an area of 2×5" on both sides of one end of each strip. The strips were allowed to dry for eight hours at ambient conditions and then were brushed down to an average coating weight of 100±10 mg/ft$^2$. Three strips were produced for each lubricant of each steel substrate type. Test strips were then drawn through a pair of mated dies containing a series of fixed draw beads. Strips were pulled a total distance of 5 inches through dies at the rate of 100 inches/minute. A certain pulling load was necessary to pull the strip versus the load exerted by the paired dies on the test specimen. The coefficient of friction was calculated for each strip. Then an average coefficient of friction was determined for each set of three test strips for each lubricant and substrate combination.

Three commercial dry film prelubes, soap-borax, acrylic polymer and hot melt metalworking lubricant, were also evaluated. In comparison, average coefficients of friction are listed below:

| | Average Coefficient of Friction | | |
|---|---|---|---|
| Lubricant | Cold Rolled Steel | Hot Dip Galvinized | Electro-Galvinized |
| Nalco Lubricant #1 | 0.0763 | 0.0656 | 0.0450 |
| Soap-Borax | 0.1163 | 0.1097 | 0.1041 |
| Acrylic Polymer | 0.1421 | 0.1248 | 0.1194 |
| Hot Melt | 0.0939 | 0.0989 | 0.0540 |

The lubricant described in Example 1 provided better lubricity (based on lower average coefficient of friction) versus three commercial dry film prelubes on all three steel test substrates.

EXAMPLE 4

The lubricant prepared as described in Example 1 above was tested to determine whether it would provide the necessary corrosion protection required for metal surfaces during periods of storage and transit in various environmental conditions of humidity and temperature. This test is one of an accelerated nature whereby the exposure to adverse conditions of temperature and humidity are increased thereby reducing the time factor for practical reasons.

Lubricants were tested on 3×6" panels of three steel substrates, cold rolled, hot dip galvanized and electrolytic galvanized. Prior to coating, panels were cleaned by washing in hexane and then air dried. The lubricant was applied at a coating weight of 200±10 mg/ft$^2$ to one side of each panel as described in Example 2. Panels were then air dried for 24 hours at ambient temperature.

The test chamber consisted of an atmosphere of condensing humidity at 100° F. and 100% relative humidity, generated by heating deionized water. The water vapor circulated continually in the chamber, condensed on the coated surfaces of the panel and washed the coating. The test panels were placed on the chamber with the coated surface facing down for maximum exposure to the condensation. Panels were always handled while wearing latex gloves to prevent surface contamination with the oils and salts commonly found on human skin. Panels were examined visually every 24 hours and test concluded when rust, corrosion or staining appeared.

For comparison, as in Example 3, acrylic polymer-based soap borax-based and hot melt metalworking dry film prelubes were also run. The corrosion results for the three lubricants are listed below:

| | Corrosion: Days to Failure | | |
|---|---|---|---|
| Lubricant | Cold Rolled Steel | Hot Dip Galvinized | Electrolytic |
| Nalco Lubricant #1 | 12 days | 10 days | 10 days |
| Soap-Borax | 4 hours | 4 hours | 10 hours |
| Acrylic Polymer | 8 days | 1 days | 1 day |
| Hot Melt | 9 days | 5 days | 9 days |

The lubricant described in Example 1 provided excellent corrosion protection under the conditions of temperature and humidity tested on all three substrates versus the three commercial dry film prelubes.

EXAMPLE 5

Steel coils and blanks may be stored under field conditions near pickling baths and cleaner lines where atmospheric acid fumes from these baths/lines can severely stain and corrode the steel. For this reason, Example 1 lubricant was tested to determine its effectiveness in protecting cold rolled steel substrates from corrosion and staining in acid environments.

A controlled atmosphere test chamber was used. The controlled atmosphere test chamber was charged with separate solutions of deionized water and hydrochloric acid solution which produced a 25 ppm acid vapor in the test chamber. A gear motor rotated a plexiglass rotor which circulated the acid vapor in the chamber. 50 mls of acid was placed in a central beaker which was surrounded by 200 mls of deionized water in the chamber bottom. Panels are suspended vertically into the chamber through slits in the chamber lid.

Prior to coating, the panels were cleaned by washing in hexane and then air dried. 3×6″ cold rolled steel panels were used as the test substrate. Lubricant was applied at a coating weight of 200±10 mg/ft$^2$ to one side panel as described in Example 2. Panels were then air dried for 24 hours at ambient temperature. Panels were always handled while wearing latex gloves to prevent surface contamination. The test chamber was run for 30 minutes prior to panel insertion to allow the acid atmosphere to equilibrate.

The panels were then placed in chamber and run for 16 hours. For comparison, the dry film acrylic polymer prelube, the dry film soap borax prelube and hot melt metalworking lubricant used in Example 3 were also run. After 16 hours, panels were removed and examined visually for the percentage of surface area that is stained or corroded. The corrosion results for the three lubricants are provided below:

| Lubricant | Degree of Stain |
|---|---|
| Nalco Lubricant #1 | No stain |
| Soap-Borax | 100% stain |
| Acrylic polymer | 100% stain |
| Hot Melt | 80% stain |

The lubricant described in Example 1 provided excellent corrosion protection against acid fumes under the conditions tested versus three commercial dry film prelubes.

EXAMPLE 6

Moisture trapped between metal layers can cause severe staining and corrosion. For this reason the lubricant described in Example 1 was evaluated to determine its ability to prevent "metal to metal" contact staining.

Coatings were evaluated on three test substrates: cold rolled steel, hot dip galvanized, and electrogalvanized. The acrylic polymer, the soap-borax dry film and hot melt metalworking lubricant prelubes described in Example 3 were used in comparison were also run. Panels of each test substrate were cleaned by washing in hexane and then air dried.

3×6″ test panels of each substrate were prepared, four of each substrate type for each of the three lubricants evaluated. Lubricant was applied at coating weight of 300±mg/ft$^2$ as described in Example 2 to both sides of each panel. The panels were then air dried for 24 hours at ambient temperature. They were always handled while wearing latex gloves to prevent surface contamination.

Four panels of each coated substrate type were stacked together, one on top of the other. Each stack was held together with four Hoffman "C" clamps, one on each side of the bundled panels. The clamps were finger-tightened and placed in a 120° F. gravity convection oven. After 24 hours, the stacks were disassembled and examined for signs of staining. If no stains were found, stacks were reassembled and placed again in the oven. The reassembled stacks were disassembled at seven-day intervals, at which time each panel visually was examined for staining. The test was concluded after four weeks. The stack stain results for the four lubricants are listed below:

| | Degree of Stain | | |
|---|---|---|---|
| Lubricant | Cold Rolled Steel | Hot Dip Galvinized | Electrolytic |
| Nalco Lubricant #1 | No stain | No stain | No stain |
| Soap-Borax | Stain | Stain | Stain |
| Acrylic Polymer | No stain | Stain | Stain |
| Hot Melt | No stain | No stain | No stain |

The lubricant described in Example 1 provided protection against "metal to metal" contact staining under the conditions tested versus the three commercial dry film prelubes.

EXAMPLE 7

Total removability of a coating from a metal substrate is very important because trace amounts of a coating could interfere with future processing operations such as painting or porcelain adhesion. For this reason the lubricant prepared in Example 1 was tested for its removability from metal substrates with a commercial alkaline cleaner. Standard cold rolled steel panels, 3×6″, were cleaned by washing in hexane and then air-dried. The lubricant was applied at a coating weight of 200±mg/ft$^2$, as described in Example 2, to one side of test panel. The panels were then air dried for 24 hours at ambient temperature.

The acrylic polymer, soap-borax dry film and hot melt metalworking lubricant prelubes of Example 3 were used as comparitives.

The panels were immersed in 1,000 ml of a commercial alkaline cleaner solution prepared at the automobile industry standard concentration of one ounce of powdered cleaner per gallon of deionized water. The cleaner solution was then warmed on a hot plate to 130° F. and maintained there with continuous mild agitation being provided by a one-inch stir bar. The coated panels were then immersed in beaker containing cleaner solution for 15 seconds, and withdrawn. The panels were then rinsed and visually examined for cleanability based on degree of coating removed and a water break free surface. If complete cleanability fails to occur, a fresh panel is immersed for additional 15 second increments. Repetitions continue until a panel surface is completely cleaned by a given immersion period. Lubricant described in Example 1 was 100% clean in 60 seconds. Other commercial dry film prelubes were 100% clean in 60 seconds for soap-borax, 125 seconds for acrylic polymer, and 150 seconds for hot melt metalworking lubricant all at 130° F. Lubricant described in Example 1 was totally removed under the conditions tested in equivalent or less times versus three commercial dry film prelubes.

EXAMPLE 8

S.E.M. photos (scanning electron microscope) of dry film prelube coatings can be used as a indicator of film morphology, coverage and performance. Photos have been taken at both 100X and 500X in both sectional and backscatter modes of lubricant described in Example 1 and three commercial dry film prelubes, acrylic-polymer, soap-borax and hot melt metalworking lubricant. The appearance and morphology of the dried film (surface contours, absence or presence of pores, presence or lack of striated layers) plays a key role in performance of that film especially regarding corrosion protection, lubricity and cleanability. Soap-borax appears as an inconsistent film, lacking uniformity and containing large areas of uncoated metal substrate, acrylic polymer appears as uneven, full of surface cracks and pores. Hot melt metalworking lubricant appear to be more consistent than the other commercial lubricants, irregular in morphology, lacking pores and closely following surface contours. The lubricant described in Example I has a very consistent and uniform appearance and morphology. Film is made up of several layers of overlapping droplets or particles very homogenous and repetitive in nature and form. The film has the appearance of a dotted matrix with uniform wetting and film coverage evident. No consistent pores or surface cracks or wrinkles are present. Thus, the lubricants described in Example 1 has a more uniform and consistent film morphology than the three commercial dry film prelubes.

Having thus described my invention, I claim:

1. A lubricant composition comprising:

2% oil-in-water emulsifier having an HLB of at least 8;

from 60 to 80% water;

at least one substantially saturated ester formed of polyhydric alcohol and at least one carboxylic acid;

an effective plasticizing amount, comprising from 0.1–5 weight percent, of a partially-esterified vegetable oil formed with an organic diacid having a molecular weight of from 250 to 500, an air-oxidized vegetable oil; and from 0.1 to 3.0 weight percent of an ethylene homopolymer, a polymer derived from ethylene and ethylenically unsaturated carboxylic acid monomers, oxidized derivatives of ethylene polymer, or mixtures thereof, said polymers having a molecular weight in excess of 2,000.

2. The lubricant of claim 1 further including from 0.1 to 3.0 weight percent of an antioxidant.

3. The lubricant of claim 2 wherein said antioxidant is a hindered phenol.

4. The lubricant of claim 1 wherein said substantially saturated ester is formed of aliphatic polyhydric alcohol having from 2 to 10 carbon atoms.

5. The lubricant of claim 4 wherein said substantially saturated ester is formed of aliphatic monocarboxylic acids having from 2 to 26 carbon atoms.

6. The lubricant of claim 5 wherein said aliphatic monocarboxylic acids have substantially unbranched carbon chains.

7. The lubricant of claim 6 wherein said substantially saturated ester has a melting point of from 30° to 100° C.

8. The lubricant of claim 7 wherein said substantially saturated ester is a diglyceride or triglyceride formed with carboxylic acids at least 90 percent of which have carbon chains containing from 14 to 22 carbon atoms.

9. The lubricant of claim 8 wherein said substantially saturated ester is substantially refined hydrogenated triglyceride derived from tallow.

10. The lubricant of claim 1 wherein said partially esterified vegetable oil is a caster oil partial ester having an acid number of 50.

11. The lubricant of claim 1 wherein said air-oxidized vegetable oil is an air-oxidized soybean oil.

12. The lubricant of claim 1 further including aspartic acid diester oleyl imidazoline.

13. The lubricant of claim 1 wherein the oil-in-water emulsifier is the ester reaction product of stearic acid and 2-amino-2-methyl-1-propanol.

14. The lubricant of claim 1 wherein said ethylene homopolymer, polymer derived from ethylene and ethylenically unsaturated carboxylic acid monomers, oxidized derivatives thereof, or mixtures thereof, is a composition having a melting point of from 85° to 115° C.

15. The lubricant of claim 1 wherein said ethylene homopolymer, polymer derived from ethylene and ethylenically unsaturated carboxylic acid monomers, oxidized derivatives thereof, or mixtures thereof, is a composition having a hardness of from 9 to 22 dmm at 25° C.

16. The lubricant of claim 1 wherein said ethylene homopolymer, polymer derived from ethylene and ethylenically unsaturated carboxylic acid monomers, oxidized derivatives thereof, or mixtures thereof, is a composition having an acid number of from 70 to 140.

17. The lubricant of claim 1 wherein said polymer derived from ethylene and ethylenically unsaturated carboxylic acid monomers is a copolymer of ethylene and acrylic acid having a hardness of from 12 to 16 and an acid number of from 110 to 130.

18. The lubricant of claim 1 having from 10 to 20 weight percent of at least one substantially saturated ester formed of an aliphatic polyhydric alcohol having from 2 to 10 carbon atoms and aliphatic monocarboxylic acids having from 2 to 26 carbon atoms.

19. A method of lubricating metal comprising; applying to metal a coating of the lubricant of claim 1 in liquid form.

20. The method of claim 19 wherein said lubricant is applied to said metal and then said metal is worked without removal of said lubricant.

* * * * *